US008781352B2

(12) United States Patent
Kim

(10) Patent No.: US 8,781,352 B2
(45) Date of Patent: Jul. 15, 2014

(54) METHOD AND APPARATUS TO CONTROL TEMPERATURE OF FUSER IN IMAGE FORMING APPARATUS BY USING POWER CAPSULE

(75) Inventor: Jin-ha Kim, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 319 days.

(21) Appl. No.: 12/969,768

(22) Filed: Dec. 16, 2010

(65) Prior Publication Data

US 2011/0142475 A1 Jun. 16, 2011

(51) Int. Cl.
*G03G 15/20* (2006.01)

(52) U.S. Cl.
USPC ..... 399/69; 399/70

(58) Field of Classification Search
USPC ..... 399/69, 70
See application file for complete search history.

(56) References Cited

U.S. PATENT DOCUMENTS 6,449,445 B1 * 9/2002 Nakamori et al. ..... 399/69
2006/0051118 A1 * 3/2006 Kaji et al. ..... 399/69
2007/0116485 A1 * 5/2007 Nishida ..... 399/69
2010/0061754 A1 * 3/2010 Ishigaya et al. ..... 399/70
2010/0322657 A1 * 12/2010 Kumada et al. ..... 399/69

FOREIGN PATENT DOCUMENTS

JP 2003-345171 12/2003

* cited by examiner

*Primary Examiner* — Ryan Walsh
(74) *Attorney, Agent, or Firm* — Stanzione & Kim, LLP

(57) ABSTRACT

A method of controlling a temperature of a fuser in an image forming apparatus includes generating a power capsule including a soft start period in which a power supply is gradually increased to improve a flicker characteristic, a full turn on period in which the power supply is maximum, and a soft end period in which the power supply is gradually decreased to improve the flicker characteristic. The power capsule is profiled to supply a constant amount of power and to satisfy a predefined requirement for flicker and harmonic characteristics of an image forming apparatus with respect to the fuser in the soft start period, the full turn on period, and the soft end period. The method includes detecting the temperature of the fuser and controlling the temperature of the fuser by performing a power control operation corresponding to the power capsule according to a temperature variation of the detected temperature of the fuser with respect to a reference temperature of the fuser.

38 Claims, 13 Drawing Sheets

WARM UP MODE PROFILE

CAPSULE#1 PROFILE

CAPSULE#2 PROFILE

CAPSULE#3 PROFILE

CAPSULE#4 PROFILE

| ITEM | PLT | PST | FIRING MODE | REMARK |
|---|---|---|---|---|
| PRINTER REF | 0.62 | 0.63 | ZVCF DUTY PROFILE SEQUENCE | ONE LAMP 800[W |
| | 0.332 | – | PHASE PROFILE SEQUENCE | ONE LAMP 800[W] |
| JIG PROFILE TEST | – | 1.895 | ZVCF NON SOFT START ON/OFF PROFILE SEQUENCE | TWO LAMP 1600[W] |
| | 0.62 | 0.75 | ZVCF PROFILE SEQUENCE | TWO LAMP 1600[W] |
| | 0.332 | 0.635 | PHASE PROFILE SEQUENCE | TWO LAMP 1600[W] |

METHOD AND APPARATUS TO CONTROL TEMPERATURE OF FUSER IN IMAGE FORMING APPARATUS BY USING POWER CAPSULE

CROSS-REFERENCE TO RELATED APPLICATIONS

This application claims the benefit of priority under 35 U.S.C. §119(a) to Korean Patent Application No. 10-2009-0125695, filed on Dec. 16, 2009, in the Korean Intellectual Property Office, the disclosure of which is incorporated herein in its entirety by reference.

BACKGROUND

1. Field of the Invention

The present general inventive concept relates to an image forming apparatus, and more particularly, to a method and apparatus to control a temperature of a fuser by using a power capsule, and an image forming apparatus including the apparatus to control a temperature of a fuser, whereby the image forming apparatus may appropriately maintain the temperature of the fuser so that the requirements for flicker and harmonic characteristics of the image forming apparatus with respect to the fuser may be satisfied.

2. Description of the Related Art

In order to satisfy the power consumption regulations for image forming apparatuses, it is necessary to reduce the print waiting time thereof. For this, a heat rise function, or a function to increase the heat, of a heat pipe is increased by decreasing a heat capacity of the heat pipe in a fuser system. However, from a control point of view, if the heat rise function of the heat pipe is increased, the number of ON/OFF times that a heater increases and thus a flicker characteristic deteriorates. Also, when the heat capacity of the heat pipe decreases, power control of the heat pipe becomes difficult, and thus, a heat rise function of a fuser creates a ripple which deteriorates the flicker characteristic. Also, when a phase control is performed to address this deterioration, a harmonic characteristic deteriorates.

SUMMARY

The present general inventive concept provides a method and apparatus to control a temperature of a fuser in an image forming apparatus by using a power capsule whereby power is optimally controlled so that the requirements for flicker and harmonic characteristics of the image forming apparatus are satisfied.

The present general inventive concept also provides an image forming apparatus with optimal power control so that the flicker and harmonic characteristics of the image forming apparatus are satisfied.

Additional aspects and utilities of the present general inventive concept will be set forth in part in the description which follows and, in part, will be obvious from the description, or may be learned by practice of the present general inventive concept.

Features and/or utilities of the present general inventive concept may be realized by a method of controlling a temperature of a fuser of an image forming apparatus, the method including the operations of generating a power capsule having a predetermined power and satisfying a predefined requirement for flicker and harmonic characteristics of the image forming apparatus with respect to the fuser, detecting the temperature of the fuser, and controlling the temperature of the fuser by supplying a power to the fuser in a unit of the power capsule according to a temperature difference between the detected temperature of the fuser and a reference temperature of the fuser Features and/or utilities of the present general inventive concept may also be realized by a method of controlling a temperature of a fuser, the method including the operations of generating a power capsule including a soft start period in which a power supply is gradually increased to improve a flicker characteristic, a full turn on period in which the power supply is maximum, and a soft end period in which the power supply is gradually decreased to improve the flicker characteristic. The power capsule may be profiled to supply a constant amount of power and to satisfy a predefined requirement for flicker and harmonic characteristics of an image forming apparatus with respect to a fuser in the soft start period, the full turn on period, and the soft end period, to detect the temperature of the fuser, and to control the temperature of the fuser by performing a power control operation according to the power capsule according to a temperature variation of the detected temperature of the fuser with respect to a reference temperature of the fuser.

Features and/or utilities of the present general inventive concept may also be realized by a fuser temperature control apparatus including a temperature sensor to detect a temperature of a fusing roller heated by a heater, a switching unit to switch a supply of power from a power supply device to the heater, and a control unit to generate a power capsule including a soft start period in which a power supply is gradually increased to improve a flicker characteristic, a full turn on period in which the power supply is maximum, and a soft end period in which the power supply is gradually decreased to improve the flicker characteristic. The power capsule may be profiled to supply a constant amount of power and to satisfy a predefined requirement for flicker and harmonic characteristics of an image forming apparatus with respect to the fuser in the soft start period, the full turn on period, and the soft end period, and to control the switching unit so as to allow a power corresponding to the power capsule to be supplied to the heater according to a temperature variation of the fusing roller.

Features and/or utilities of the present general inventive concept may also be realized by an image forming apparatus including a power supply device, a fusing roller containing at least one heater that is heated by the at least one heater, a temperature sensor to detect a temperature of the fusing roller, a switching unit to switch a supply of power from a power supply device to the heater, and a control unit to generate a power capsule including a soft start period in which a power supply is gradually increased to improve a flicker characteristic, a full turn on period in which the power supply is maximum, and a soft end period in which the power supply is gradually decreased to improve the flicker characteristic. The power capsule may be profiled to supply a constant amount of power and to satisfy a predefined requirement for flicker and harmonic characteristics of an image forming apparatus with respect to the fuser in the soft start period, the full turn on period, and the soft end period, and to control the switching unit so as to allow power corresponding to the power capsule to be supplied to the heater according to a temperature variation of the fusing roller.

Features and/or utilities of the present general inventive concept may also be realized by a method of controlling a temperature of a heating unit including detecting the temperature of the heating unit and generating a power capsule to a adjust the temperature of the heating unit when the detected temperature is less than a target temperature.

The generated power capsule may have power characteristics that correspond to the difference between the detected temperature and the target temperature.

The power capsule may be generated using a phase profile sequence.

The power capsule may be generated using a "number of waveform" duty profile sequence.

The temperature of the heating unit may be repeatedly detected, and a plurality of power capsules having different power characteristics may be generated when a plurality of difference temperatures may be detected.

The heating unit may have a warm-up mode, a full-power mode, and a ready mode, and power capsules having different power characteristics may be generated in each of the warm-up mode, the full power mode, and the ready mode, respectively.

The heating unit may include a plurality of heating units, each power capsule may include a ramp-up portion during which power may be increased, a ramp-down portion in which power may be decreased, and a sustained power portion between the ramp-up portion and the ramp-down portion during which power may be sustained, and the method may further include delaying generating a second power capsule to a second of the plurality of heating units when a ramp-up portion of a first power capsule is supplied to a first heating unit of the plurality of heating units.

Features and/or utilities of the present general inventive concept may also be realized by a fusing unit including a heating unit to receive a power capsule to heat the fusing unit.

The fusing unit may include a sensor to detect a temperature of the fusing unit, and the power capsule may be supplied to the heating unit when a the detected temperature of the fusing unit is less than a target temperature.

Features and/or utilities of the present general inventive concept may also be realized by a fuser temperature control apparatus including a sensor to detect a temperature of a fusing unit, a switching unit to switch on and off a power capsule supplied to the fusing unit, and a control unit to control the switching unit to supply the power capsule to the fusing unit when the detected temperature is less than a target temperature.

The control unit may generate the power capsule to have power characteristics based on the difference between the detected temperature and the target temperature.

The power capsule may include a power ramp-up portion, a power ramp-down portion, and a sustained power portion between the ramp-up portion and the ramp-down portion, and the control unit may generate the power capsule to have a sustained power portion that may have a duration that corresponds to the difference between the detected temperature and the target temperature, such that a larger difference corresponds to a longer duration than that of a smaller difference.

The control unit may generate the power capsule using a phase profile sequence.

The control unit may generate the power capsule using a "number of waveforms" duty profile sequence.

The control unit may generate a plurality of power capsules having different power characteristics to correspond to a warm-up mode, a full-power mode, and a ready mode of the heating unit.

The heating unit may include a plurality of heating units, each power capsule may include a power ramp-up portion, a power ramp-down portion, and a sustained power portion between the ramp-up portion and the ramp-down portion, and the control unit delays generating a second power capsule to a second of the plurality of heating units when a ramp-up portion of a first power capsule may be supplied to a first heating unit of the plurality of heating units.

Features and/or utilities of the present general inventive concept may also be realized by an image forming apparatus including a fusing unit including a heater to heat the fusing unit, a power supply device to supply power to the fusing unit, and a fuser temperature control apparatus to control the supply of power from the power supply device to the fusing unit, the fuser temperature control apparatus comprising a sensor to detect a temperature of the fusing unit and a controller to control the power from the power supply device to generate a power capsule to supply to the fusing unit to heat the fusing unit.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1A:
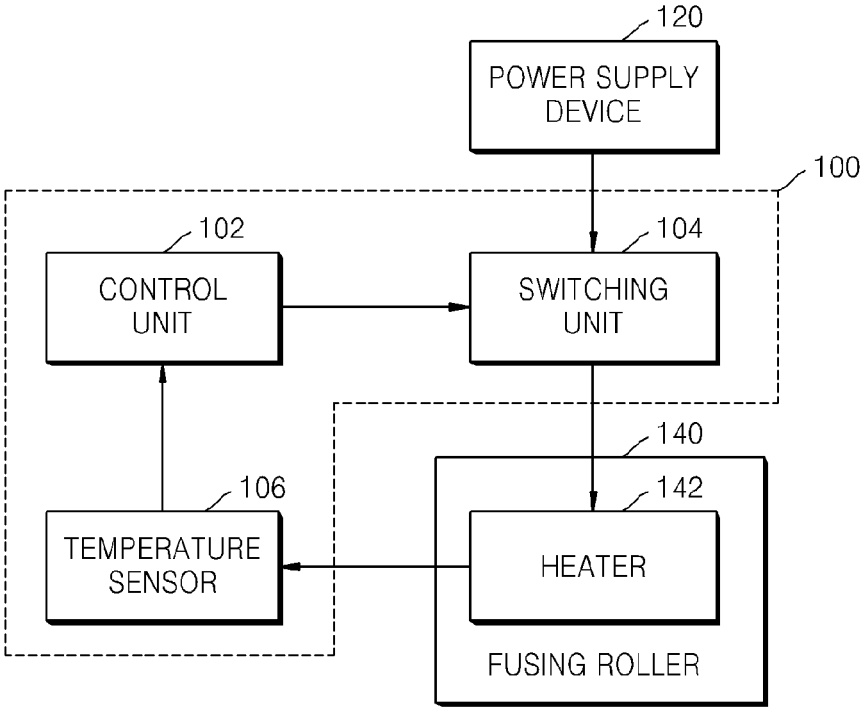
FIGS. 1A and 1B are block diagrams of an image forming apparatus including a fuser temperature control apparatus using a power capsule according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

In order to satisfy the requirements for a flicker characteristic of an image forming apparatus, power is soft started and soft ended in a lamp load (heater) so that the flicker characteristic is improved. However, by doing so, the number of times a phase control is performed increases, and thus, the requirements for a harmonic characteristic are not satisfied. A waveform number control provides a low power control ability to the image forming apparatus. When the number of times power is turned ON or OFF is reduced (that is, when the waveform number control is performed), the flicker characteristic is improved. However, when the power control is inadequate, it is necessary to increase a temperature ripple. However, by doing so, the lifetime and function of a fuser deteriorate.

Meanwhile, in order to satisfy the requirements for the harmonic characteristic of the image forming apparatus, it is necessary to control the harmonic characteristic according to a ratio of the phase control to the waveform number control. The waveform number control is appropriate to satisfy the harmonic characteristic and Electromagnetic Interference (EMI), but provides the low power control ability and thus is limited in overcoming the flicker characteristic.

Figure 2A:
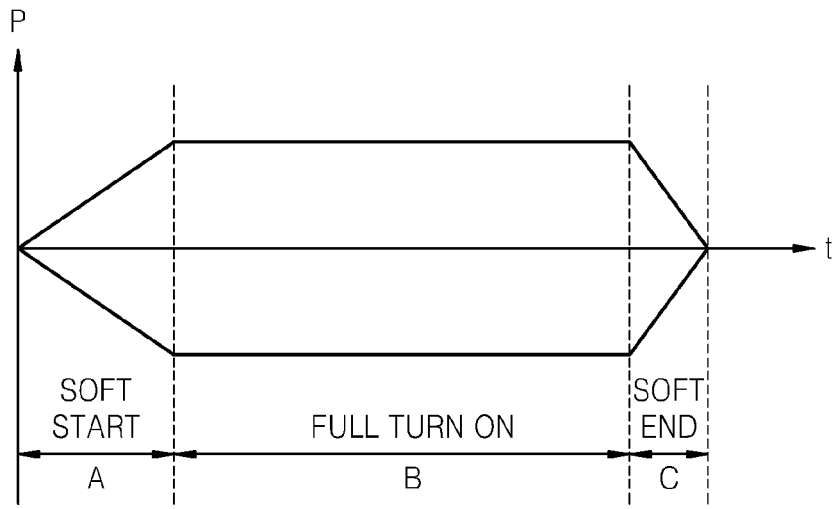
FIGS. 2A to 2C are diagrams illustrating power capsules.
Figure 2B:
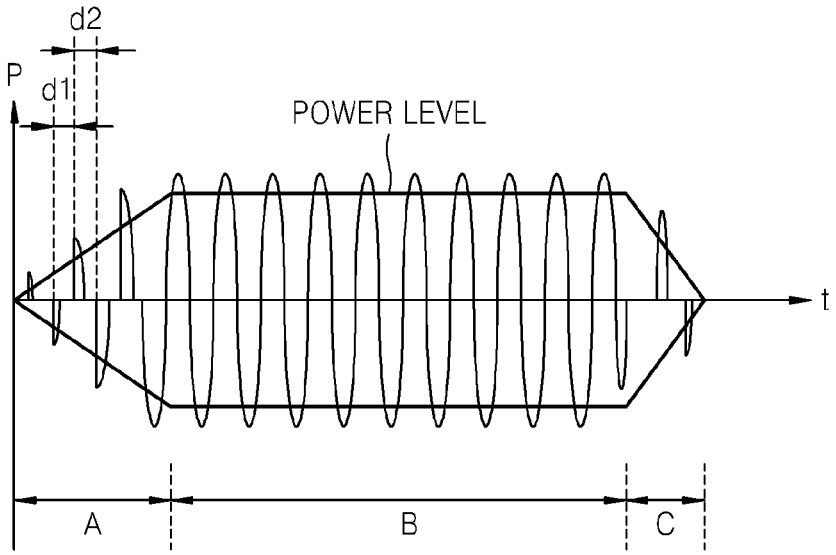
Figure 2C:
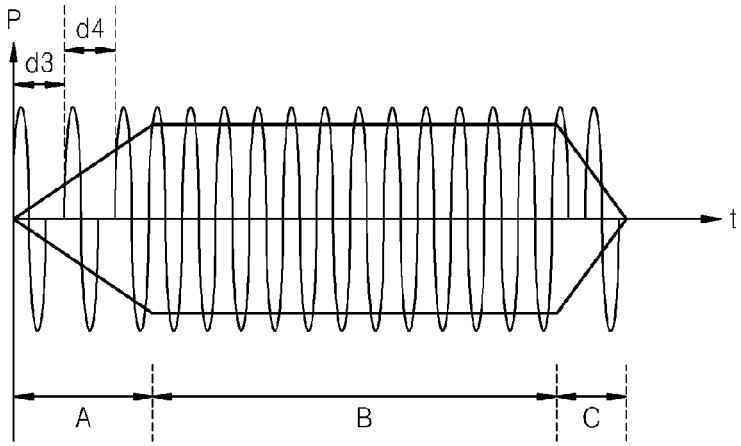

FIG. 1A is a block diagram of an image forming apparatus including a fuser temperature control apparatus 100 using a power capsule according to an embodiment of the present general inventive concept. Examples of power capsules are illustrated in FIGS. 2A to 2C.

The image forming apparatus of FIG. 1A includes the fuser temperature control apparatus 100, a power supply device 120, and a fusing roller 140 including a heater 142. The power supply device 120 supplies power to the heater 142 included in the fusing roller 140. The heater 142 receives the power from the power supply device 120 and heats the fusing roller 140.

The fuser temperature control apparatus 100 controls the supply of power from the power supply device 120 to the heater 142, and includes a control unit 102, a switching unit 104, and a temperature sensor 106.

The temperature sensor 106 detects a temperature of the fusing roller 140. The switching unit 104 switches the supply of power from the power supply device 120 to the heater 142.

The control unit 102 generates control signals corresponding to a power capsule and controls the switching unit according to the control signals. In turn, the power is supplied to the heater 142 in the form of the power capsule.

The term "power capsule" as used in the present specification and claims refers to a pattern of a power signal that is in the shape of a "capsule." In other words, the power signal may have an AC voltage component, and the power level may gradually increase on either side of a reference power level, may even out in a center portion to have a sustained power level, and may gradually decrease at a trailing end of the power capsule. The power level may be calculated by the formula $P=V\cdot I\cdot\cos(\theta)$.

FIG. 2A is a diagram illustrating a power capsule including a soft start period A, a full turn on period B, and a soft end period C.

In the soft start period A, a power supply to the heater 142 is gradually increased or ramped up to the full power level. Since the power is based on an AC voltage signal, the power level gradually increases in both a positive and negative direction with respect to a reference power level according to the positive and negative swings of the AC signal. The gradual increase of power improves flicker characteristics of the fusing roller by decreasing the flicker.

Figure 3:
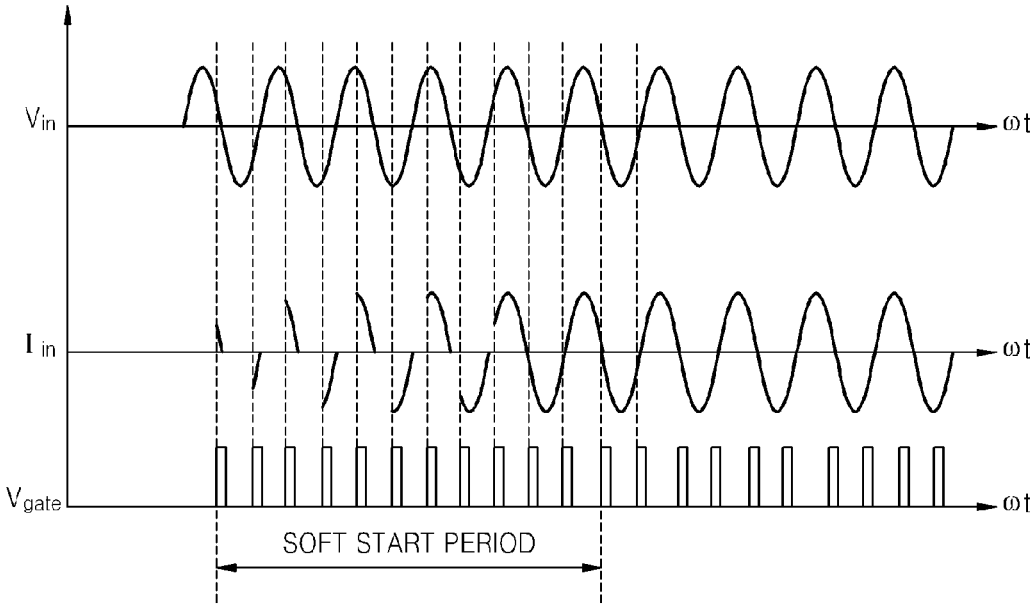
FIG. 3 is a graph of an example of a phase control used in a soft start period.

FIG. 3 is a graph of an example of the phase control used in the soft start period A. When the soft start portion A is generated using the phase control profile, a portion of the waveform that is supplied to the heater 142 is gradually increased. The gradual increase may be achieved by gradually increasing a duration in which current is supplied, for example. When the phase control is performed in the soft start period A, a flicker characteristic decreases as a duration of the soft start period A increases. Although the phase control may deteriorate a harmonic characteristic, the phase control efficiency is better than that of the waveform number control profile, so that the phase control is appropriate for a high-speed printer. The "waveform number" control profile may be performed to gradually increase the power supply by increasing the number of waveforms in the soft start period A. Although the waveform number control may be less efficient than the phase control profile, the harmonic characteristic is still improved so that the waveform number control is appropriate for a low-speed printer.

FIG. 3 illustrates a switch control signal, $V_{gate}$, that may be used to turn on the switching unit 104. In FIG. 3, the control signal $V_{gate}$ is illustrated as a pulse signal and the voltage $V_{in}$ is supplied from the power supply device 120 to the fusing roller 140 according to a change in the current $I_{in}$, which may be controlled according to additional control signals from the control unit 102. However, according to an embodiment, the control signal $V_{gate}$ may increase in duration to increase the amount of time that the current is supplied through the switching unit 104. In addition, a duration between $V_{gate}$ pulses may be changed to change a duration between voltage and current waveforms supplied from the power supply device 120.

Referring again to FIG. 2A, in the full turn on period B, a maximum power is supplied, and the harmonic characteristic that may have deteriorated during the soft start period A may be improved.

In the soft end period C, the procedure performed in the soft start period A is performed in a reverse manner, and may have a power about 30% of a power of the soft start period A. In other words, the duration of the soft end period C may be shorter than that of the soft start period A.

FIGS. 2B and 2C illustrate example embodiments of power capsules. In FIG. 2B, a phase control profile is used to generate the soft start period A and soft end period C. In the phase control profile method, a duration between the beginnings of adjacent waveforms is constant. In other words, d1=d2. The magnitude of the power is gradually increased during the soft start period A and gradually decreased during the soft end period C. In FIG. 2B, the power level is measured based on a value less than a peak-to-peak power value. For example, the power may be based on the rms voltage or average voltage levels.

FIG. 2C illustrates a power capsule generated with the "waveform number" control profile method. In FIG. 2C, each of the generated waveforms is a complete waveform and each waveform has the same amplitude. However, the frequency at which the waveforms are generated gradually increases in the soft start period A and gradually decreases in the soft end period C. The waveforms are continuous and un-broken during the full-power period B. In other words, during the soft start period A, a duration of each waveform is the same, but the duration between adjacent waveforms gradually increases during the soft start period A. Consequently, d3>d4.

Figure 1B:
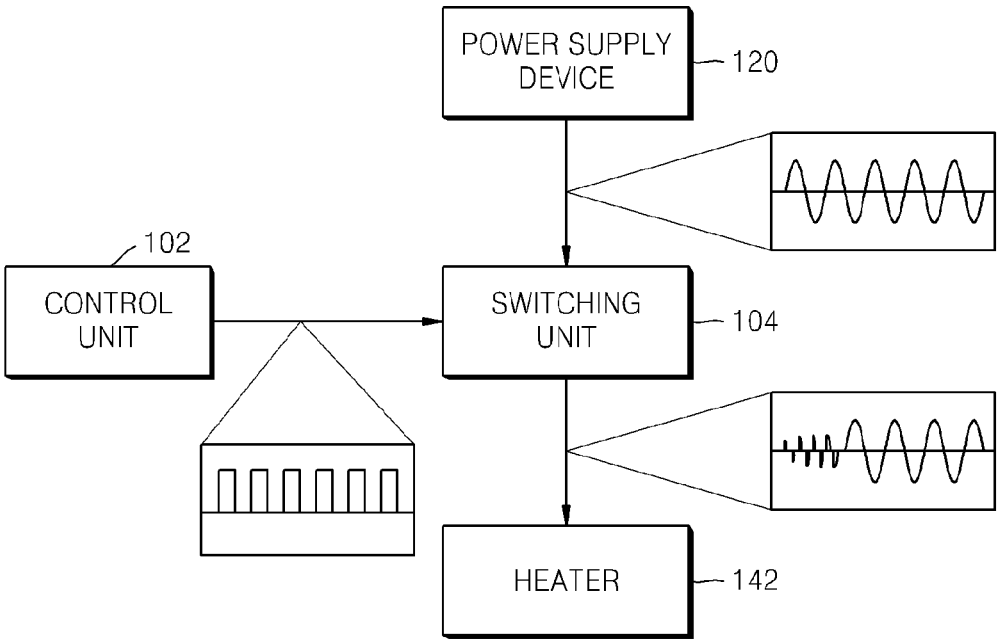

FIG. 1B illustrates an example of a control unit 102 controlling the switching unit 104 to generate the power capsule and the transmit the power capsule to the heater 142.

Figure 1C:
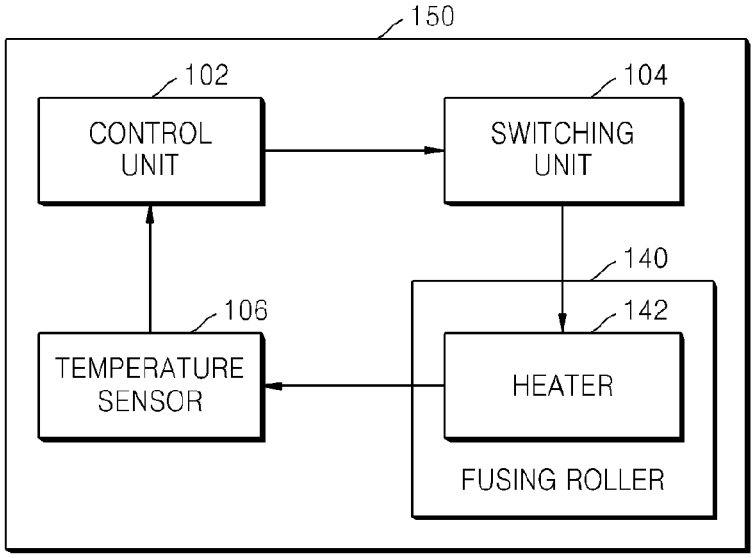
FIG. 1C is a block diagram of an alternative configuration of the image forming apparatus.

While FIG. 1A illustrates the fuser temperature control apparatus 100 as being separate from the fusing roller 140, the control unit 102, switching unit 104, temperature sensor 106, and fusing roller 140 may all be part of a fusing unit 150, as illustrated in FIG. 1C. The fusing unit 150 may be a single device that may be mounted in an image forming apparatus to receive power from a power supply of the image forming apparatus, for example. The fusing unit 150 may include one or more of the control unit 102, switching unit 104, the temperature sensor 106, and the fusing roller 140. Alternatively, the control unit 102 may be a control unit 102 that is a separate device from the fusing unit 150 and is connected to the fusing unit 150 via a connection port, for example.

Figure 1D:
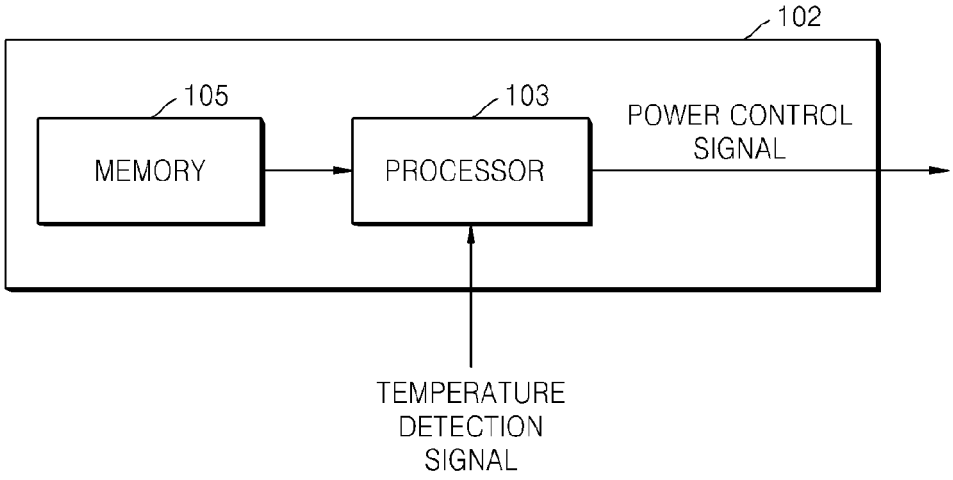
FIG. 1D is a block diagram of a control unit of the image forming apparatus.

FIG. 1D illustrates an example of a control unit 102 according to an embodiment of the present general inventive concept. The control unit 102 may include a processor 103 that may receive a temperature detection signal. The processor 103 may include an ALU and other logic components to compare the detection signal to a target value. The processor 103 may access control data stored in memory 105 corresponding to power capsule signals. In other words, the processor 103 may determine a difference between the detected temperature and the target temperature, may access form memory 105 power control signals to generate an appropriate power capsule, and may output the power control signals to control power to a heater 140.

A plurality of power capsules may be used according to the desired amount of power supply, and each profile of the power capsules may be optimally configured to satisfy the requirements for the flicker and harmonic characteristics. An optimal profile may be profiled in such a manner that a temporal proportion between the soft start period A, the full turn on period B, and the soft end period C is constant. In other words, when a plurality of power capsules is used, a ratio of the durations of A:B:C may be constant in each of the plurality of power capsules, even when the duration of a soft start period A is different from one capsule to another. In addition, with respect to a profile setting in the soft start period A and the soft end period C, phase values in the soft start period A and the soft end period C may be configured as a look-up table so as to control a ratio of a power amount variation with respect to a time variation to be constant according to a load characteristic.

Figure 6:
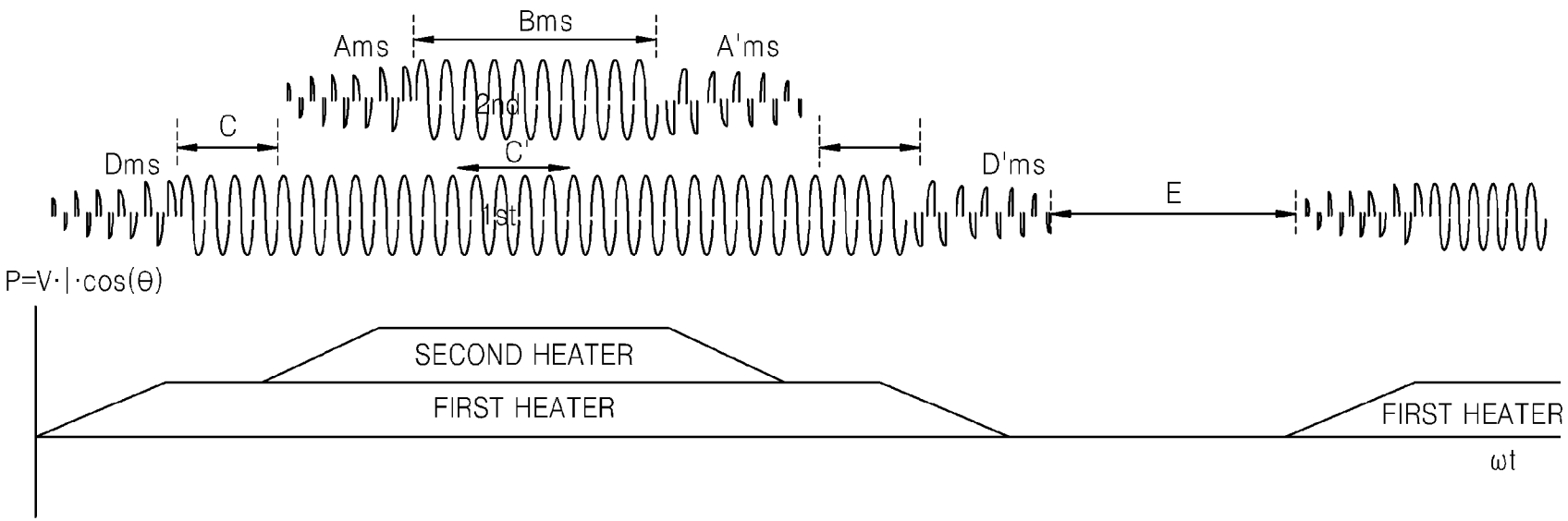
FIG. 6 is a graph of a plurality of power capsules used when a plurality of heaters are employed.

As illustrated in FIG. 6, when a plurality of heaters is used, the power capsules for the plurality of heaters may have different profiles D, C', D', A, B, and A', and a minimum gap C with respect to a heater-ON time period may be set to prevent a first heater and a second heater from being simultaneously turned ON. Although the heaters may be ON at full power at the same time, they may be prevented from ramping up or soft starting at the same time. The power capsules may be used to increase a fuser control effect by controlling the profiles of the power capsules according to a temperature difference between a temperature of the fuser and a reference temperature of the fuser according to a printing mode.

The image forming apparatus according to the present embodiment controls the temperature of the fuser by detecting the temperature of the fuser and then performing a switching operation so as to used the proper power capsule according to the temperature difference. In this regard, the image forming apparatus may control the temperature of the fuser by varying the levels of the power capsules and the number of the power capsules according to each of an initial warm up period, a continuous printing period, and a ready period corresponding to a standby period in which a printing operation is not performed.

For example, a power capsule corresponding to a warm up mode profile may be used in the initial warm up period, a large number of power capsules may be used in the continuous printing period, and a power capsule corresponding to a ready mode profile may be used in the ready period. Also, the temperature of the fuser may be controlled by varying the levels of the power capsules used in the initial warm up period, the continuous printing period, and the ready period may vary.

Figure 4:
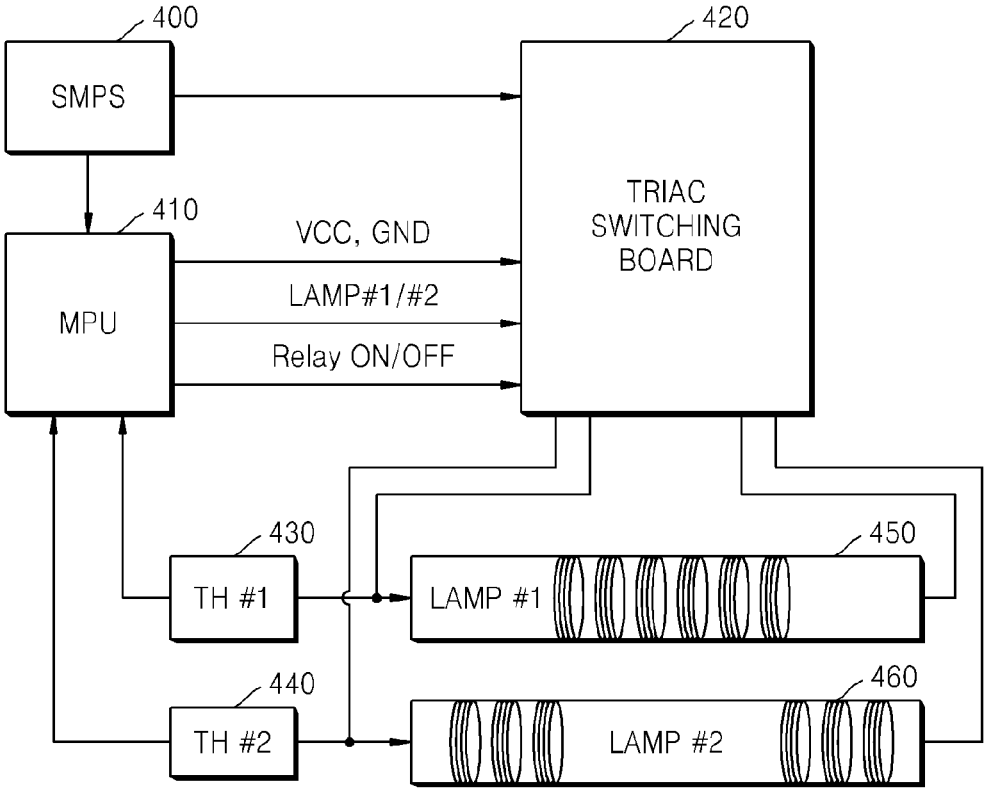
FIG. 4 is a diagram of an example of the image forming apparatus including the fuser temperature control apparatus using the power capsule.

FIG. 4 is a diagram of an example of the image forming apparatus including the fuser temperature control apparatus 100 using the power capsule. In FIG. 4, a switching-mode power supply (SMPS) 400 corresponds to the power supply device 120 of FIG. 1, a microprocessor unit (MPU) 410 corresponds to the control unit 102, a TRIAC switching board 420 corresponds to the switching unit 104, TH1 430 and TH2 440 correspond to the temperature sensor 106, and LAMP #1 450 and LAMP #2 460 correspond to the fusing roller 140 including the heater 142.

In FIG. 4, the sensors 430 and 440 sense the temperatures of the lamps 450 and 460, respectively. The MPU 410 receives the detection signals, and controls the TRIAC switching board 420 to supply power to the lamps 450 and 460. The MPU 410 may supply control signals to turn relays of the TRIAC 420 on and off, to turn the lamps 450 and 460 on and off, and to supply VCC and GND signals to the TRIAC switching board 420. If the MPU 410 determines that the temperature of lamp 450 is below a target temperature, the MPU 410 may generate a control signal to generate a power capsule. According to one embodiment, the MPU controls the TRIAC switching board 420 to generate the power capsule. Alternatively, the SMPS 400 may supply power to the MPU 410, and the MPU 410 may generate the power capsule signal which may be passed through the TRIAC switching board 420 and passed to the lamps 450 and 460.

Figure 5A:
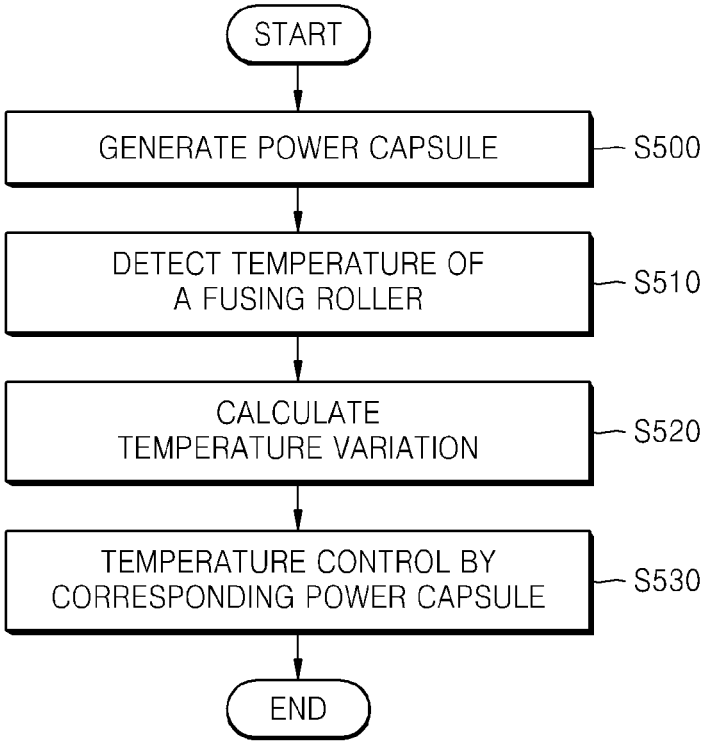
FIGS. 5A to 5C are flowcharts of methods of controlling a temperature of a fuser by using a power capsule, according to an embodiment of the present general inventive concept.

FIG. 5A is a flowchart of a method of controlling a temperature of a fuser by using a power capsule, according to an embodiment of the present general inventive concept. Hereinafter, the method of controlling the temperature of the fuser by using the power capsule will be described with reference to FIGS. 1A and 5A. First, the method involves generating, in operation S500, the power capsule for supplying a constant amount of power to the heater 142 while the predetermined requirements for the flicker characteristic and the harmonic characteristic of the image forming apparatus with respect to the fuser are satisfied. The constant amount of power may refer to an average power when the voltage source is an AC voltage, for example. In addition, the constant power may refer to the full power period of the power capsule, as illustrated in FIG. 2A, for example.

The power capsule may be generated by saving control signals in memory to be accessed when temperature differences are detected between a detected temperature and a target temperature. A plurality of power capsules may be used according to the amount of a power supply, and each profile of the power capsules may be optimally designed to satisfy the requirements for the flicker and harmonic characteristics. When the profiles of the power capsules are generated, the levels and number of periods of the power capsules may vary for each of an initial warm up period, a continuous printing period, and a ready period corresponding to a standby period in which a printing operation is not performed. The profiles of the power capsules may be configured in a look-up table and stored in the control unit 102.

When a temperature of the fusing roller 140 is detected in operation S510 by using the temperature sensor 106, a temperature variation with respect to a reference temperature of the fusing roller 140 is calculated in operation S520.

The control unit 102 switches the switching unit 104 in operation S530 so as to allow a power corresponding to the power capsule to be supplied to the heater 142 according to the temperature variation with respect to the reference temperature, thereby controlling the temperature of the fusing roller 140.

Figure 5B:
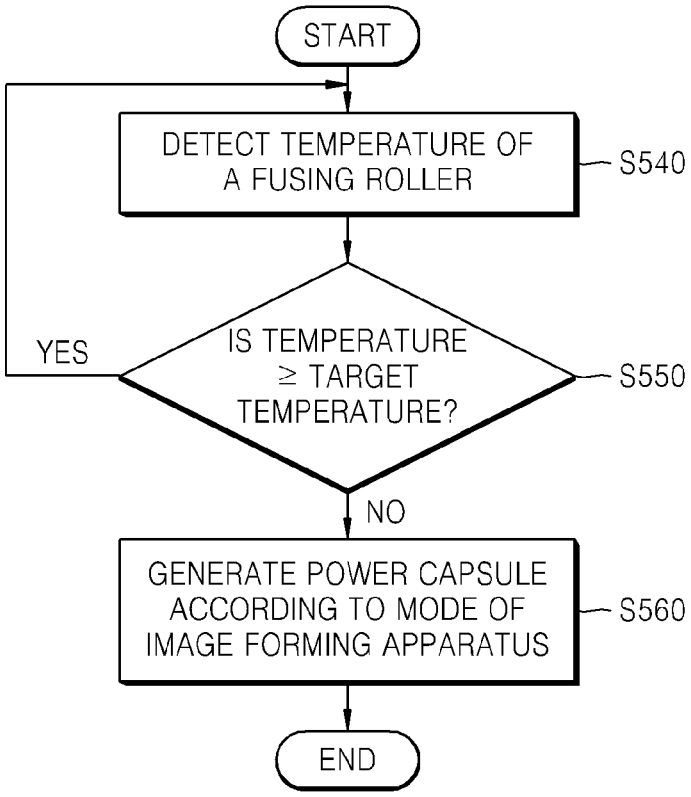

FIG. 5B illustrates another embodiment of a method of controlling power to a fusing roller. In operation S540, a temperature of the fusing roller is detected. In operation S550, it is determined whether the detected temperature is less than a target temperature. If the detected temperature is not less than the target temperature, no power capsule is generated, and the temperature is continuously detected. On the other hand, if the detected temperature is determined to be less than the target temperature, then in operation S560, a power capsule is generated according the detected difference between the detected temperature and the target temperature and/or a mode of the image forming apparatus in which the fusing roller is located.

Figure 5C:
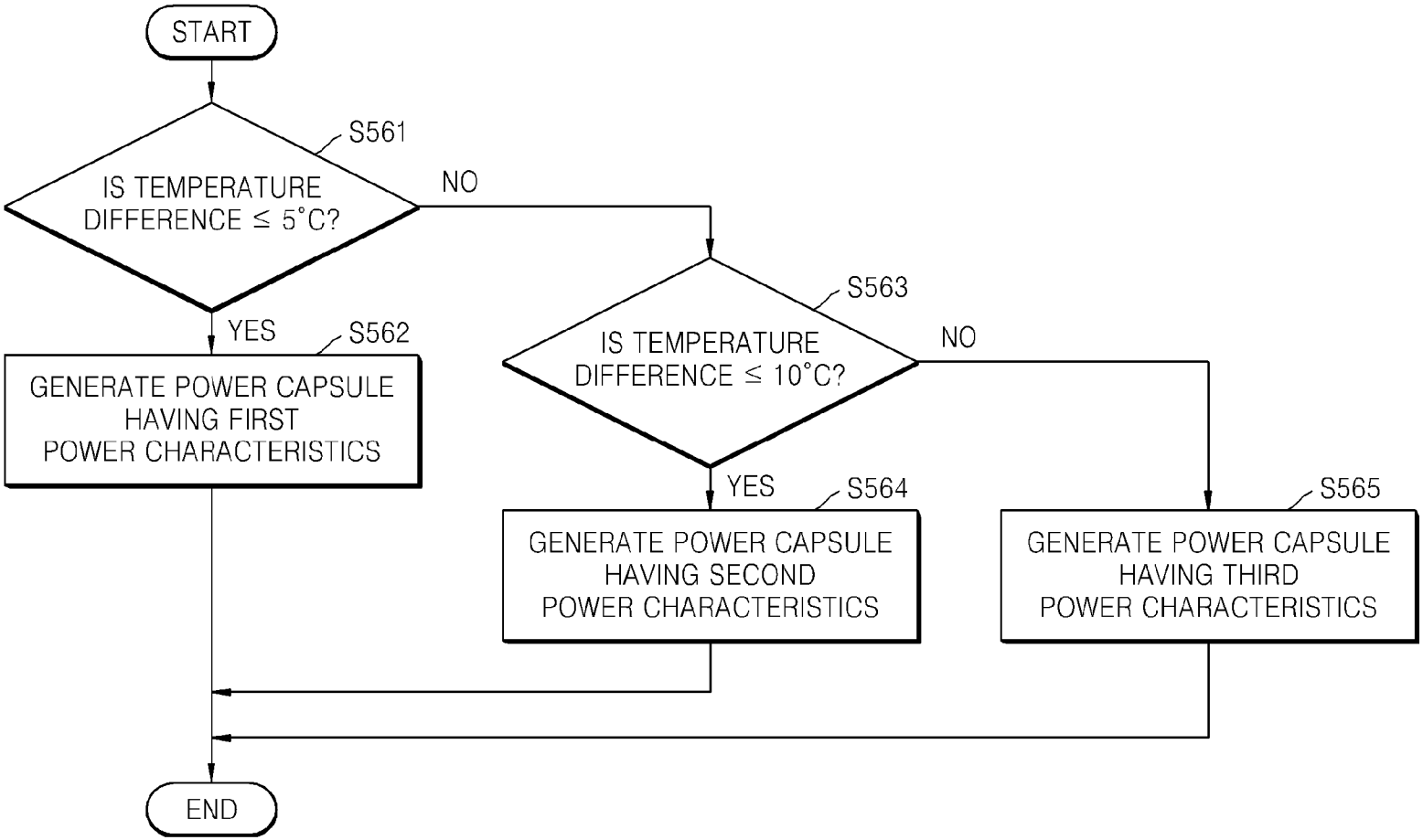

As illustrated in FIG. 5C, a different power capsule may be generated depending upon the calculated difference between the detected temperature and the target temperature. In operation S561, it is determined whether the difference is less than 5° C. If so, a power capsule is generated in operation S562 having first power characteristics, such as low power characteristics. In operation S563, it is determined whether the difference is less than 10° C. If so, a power capsule is generated in operation S564 having second power characteristics, such as medium power characteristics. On the other hand, if it is determined in operation S563 that the temperature difference is not less than 10° C., a power capsule may be generated in operation S565 having third power characteristics, such as high power characteristics.

Figure 7A:
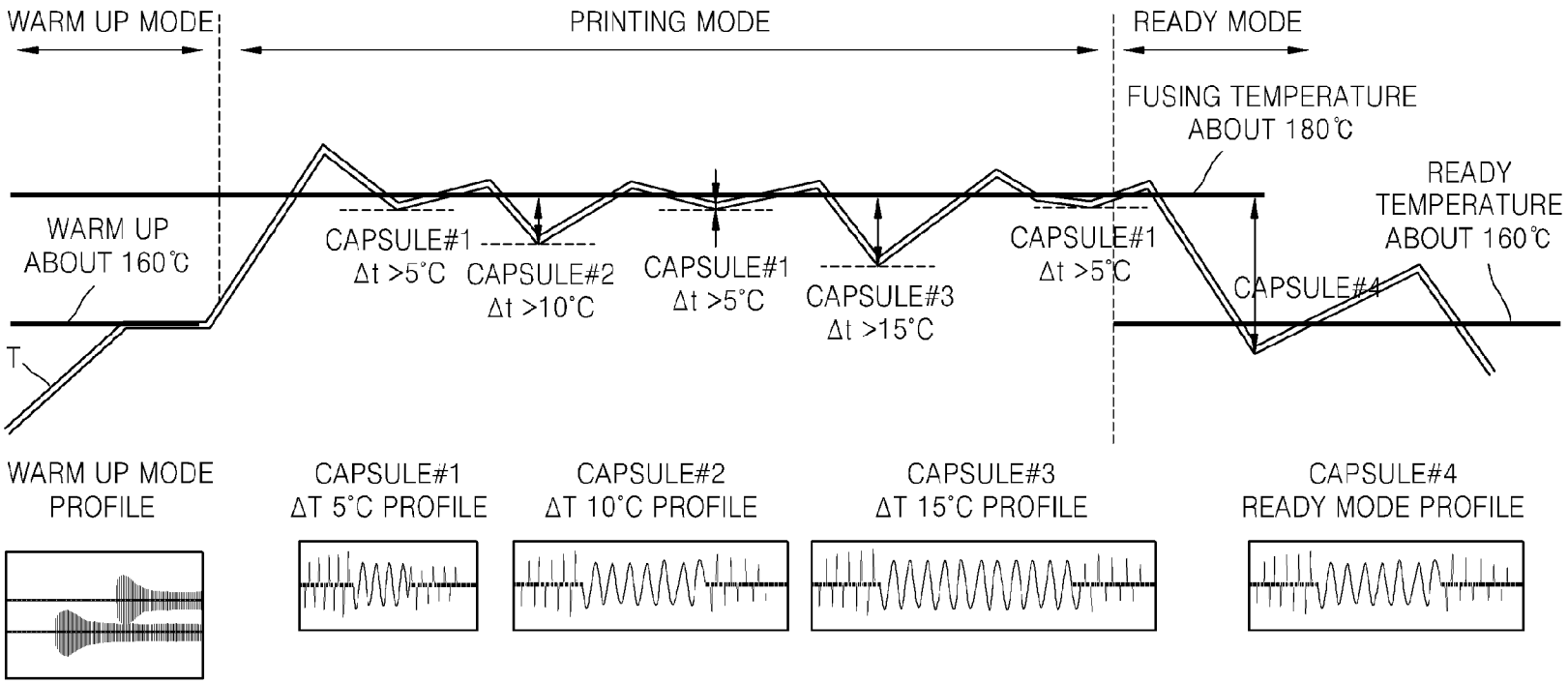
FIGS. 7A to 7F illustrate power capsules to control a temperature of a fuser.
Figure 7B:
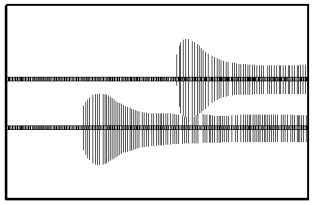
Figure 7C:
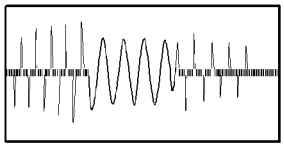
Figure 7D:
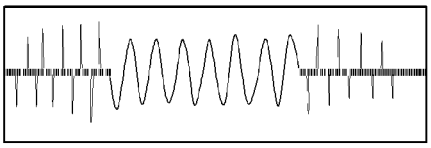
Figure 7E:
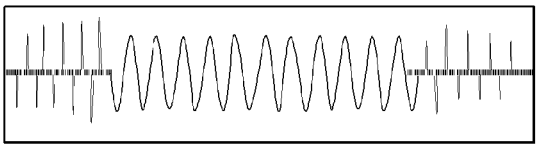
Figure 7F:
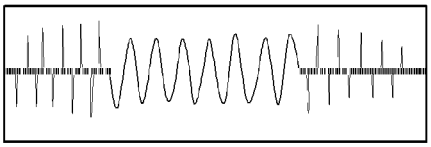

FIG. 7A is a diagram illustrating a case in which a temperature T of a fuser is controlled by using a plurality of different power capsules. First, the control unit 102 generates one or more power capsules that correspond to a warm up mode profile. The warm-up mode capsule may include an initial high power level that is reduced to a lower, constant power level. In FIG. 7B, two separate heaters may be heated according to the warm-up profile. During a printing mode, or a mode in which the heaters of the fusing roller are engaged in printing operation of the image forming apparatus, the control unit 102 generates different power capsules to correspond to detected differences between a temperature of the fusing roller and a target temperature. The temperature of the fusing roller may be detected at predetermined times, such as at regular intervals or constant intervals. If a temperature variation of 5° C. is detected, the control unit 102 may generate a first power capsule, or capsule #1 having a relatively low power level. If a temperature variation of 10° C. is detected, the control unit 102 may generate a second power capsule, or capsule #2 having a medium power level. If a temperature variation of 15° C. is detected, the control unit 102 may generate a third power capsule, or capsule #3 having a relatively low power level. FIGS. 7C to 7E illustrate examples of power capsules #1 to #3. As illustrated in FIGS. 7C to 7E, a power capsule having a larger power level may be generated by generating a power capsule having a longer duration. When the fusing roller 140 is in a ready mode, the control unit 102 generates a fourth power capsule, or capsule #4 illustrated in FIG. 7F, when the detected temperature is different than the target temperature. The capsules #1 to #4 and the warm-up mode capsule may be stored in memory, such as in a look-up table that may be accessed by, or located within, the control unit 102.

In this manner, according to the embodiments of the present general inventive concept, the temperature of the fuser in the image forming apparatus is controlled by power capsules. The temperature may be controlled by varying the levels of the power capsules for each of the warm up period, the continuous printing period, and the ready period, or may be controlled by varying the number of the power capsules. When the temperature is controlled with power capsules, the power capsules may be generated to reduce negative flicker and harmonic characteristics, so that it is possible to control the temperature of the fuser while improving flicker and harmonic characteristics.

Figure 8:
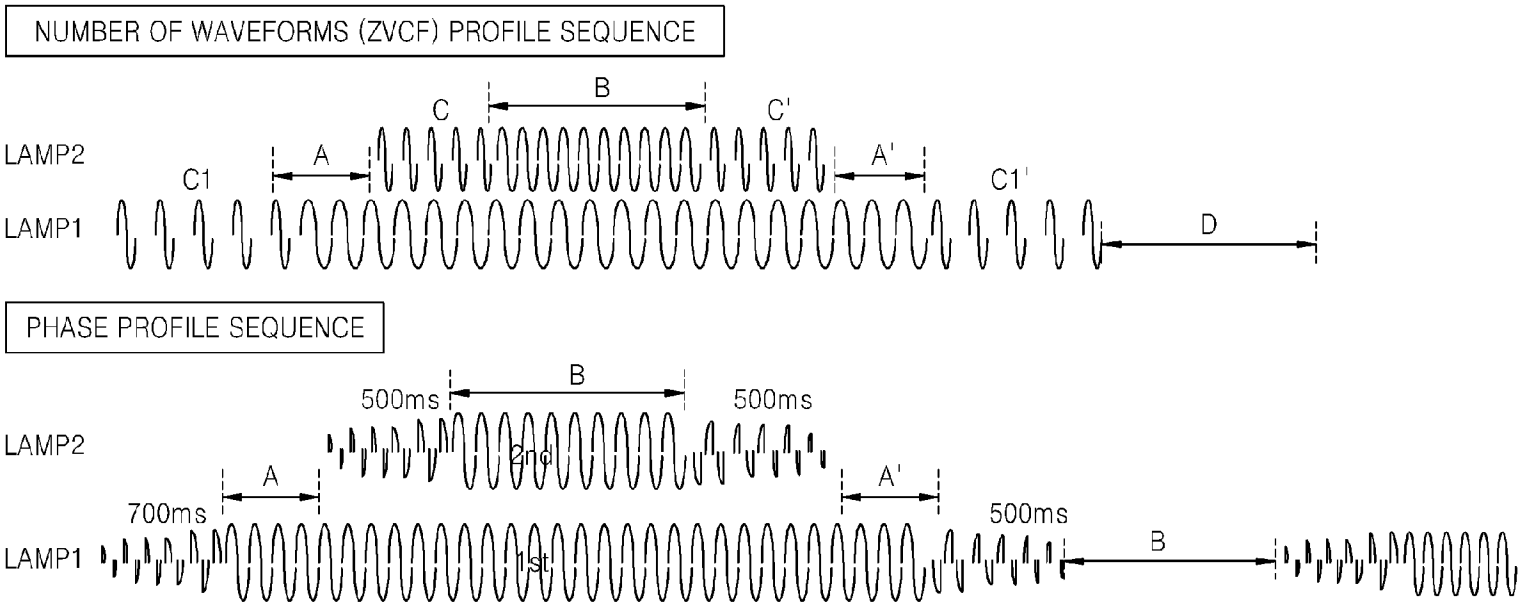
FIG. 8 is a diagram illustrating an effect according to two-profile control.

FIG. 8 is a diagram illustrating controlling the power supplied to a fusing roller using the "number of waveforms" profile method and the phase control profile method. FIG. 8 illustrates a Plt value and a Pst value with respect to the number of waveforms profile method, which may also be referred to as a waveform number zero voltage crossing firing (ZCVF) trickle profile sequence, and the phase control profile sequence.

When a single 800 W lamp is controlled in a reference printer or imaging apparatus, the Plt value indicating a flicker value in a ready mode is 0.62 in a ZCVF duty profile sequence and is 0.332 in the phase profile sequence. The Pst value indicating a flicker value in a printing mode is 0.63 in the ZCVF duty profile sequence. Since it is necessary for the flicker value to be equal to or less than 1 according to a predetermined flicker requirement, it is possible to see that the Plt and Pst values satisfy the flicker requirements when the present general inventive concept is implemented in the reference imaging apparatus.

When two 800 W lamps (totaling 1600 W) are controlled in a JIG profile test, the Plt value indicating a flicker value in a ready mode is 0.62 in a ZCVF duty profile sequence, and 0.332 in the phase profile sequence. The Pst value indicating a flicker value in a printing mode is 1.895 in a ZCVF Non Soft Start ON/OFF profile sequence. Although the Pst value 1.895 exceeds the flicker requirement in the Non-Soft Start profile sequence, the Pst value is 0.75 in the ZCVF duty profile sequence and 0.635 in the phase profile sequence. Accordingly, the Plt and Pst values satisfy the flicker requirements since it is necessary for the flicker value to be equal to or less than 1.

Figure 9:
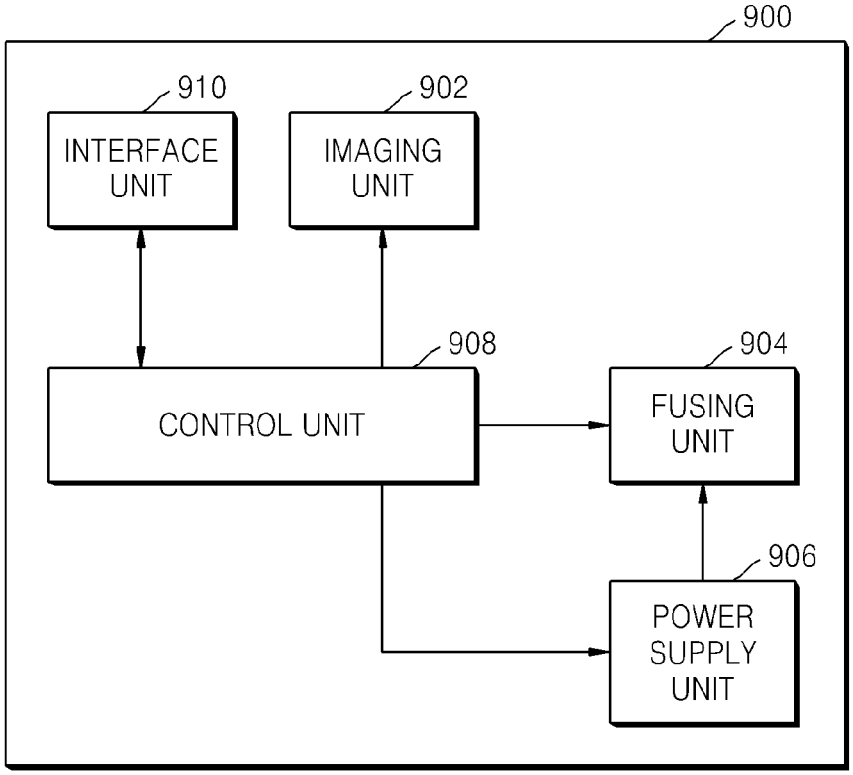
FIG. 9 illustrates an image forming apparatus according to an embodiment of the present general inventive concept.

FIG. 9 illustrates an image forming apparatus 900 according to an embodiment of the present general inventive concept. The image forming apparatus 900 includes an imaging unit 902 to scan and/or print documents, a fusing unit 904 to fuse toner to a document, and a power supply unit 906 to supply power to the fusing unit 904. A controller 908 controls operation of the imaging unit 902, the fusing unit 904, and the power supply unit 906. An interface unit 910 may receive commands from a user or from another device, and may transmit data, including commands and/or image data to and from a user and/or another device. The control unit 908 may correspond to the control unit 102 of FIG. 1, or the fusing unit 904 may include a separate control unit. The fusing unit 904 may correspond to the fusing roller 140 and one or more of the switching unit 103, temperature sensor 106, and control unit 102 of FIG. 1A. The power supply unit 906 may correspond to the power supply device 120 of FIG. 1A, or the fusing unit 904 may include a separate power supply unit.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A method of controlling a temperature of a fuser of an image forming apparatus, the method comprising:

generating a plurality of power capsules each having a pattern of a power signal that is in the shape of a capsule, wherein a power level gradually increases, evens out at a sustained center portion and gradually decreases at a trailing end, and each having a different predetermined power pattern according to a predefined requirement for flicker and harmonic characteristics of the image forming apparatus with respect to the fuser;

detecting the temperature of the fuser; and controlling the temperature of the fuser by supplying a power to the fuser in a unit of a power capsule selected from among the plurality of power capsules according to a temperature difference between the detected temperature of the fuser and a reference temperature of the fuser.

2. A method of controlling a temperature of a fuser, the method comprising:

generating a plurality of power capsules each including a soft start period in which a power supply is gradually increased to improve a flicker characteristic, a full turn on period in which the power supply is maximum, and a soft end period in which the power supply is gradually decreased to improve the flicker characteristic, wherein the plurality of power capsules are each profiled to supply a constant amount of power and to satisfy predefined requirements for flicker and harmonic characteristics of an image forming apparatus with respect to a fuser in the soft start period, the full turn on period, and the soft end period;

detecting the temperature of the fuser; and controlling the temperature of the fuser by performing a power control operation according to a power capsule selected from among the plurality of power capsules to correspond to a temperature variation of the detected temperature of the fuser with respect to a reference temperature of the fuser.

3. The method of claim 2, wherein the power supply is conducted by performing a phase control or a waveform number control in the soft start period and the soft end period.

4. The method of claim 2, wherein each of the plurality of power capsules is profiled so that a temporal proportion between the soft start period, the full turn on period, and the soft end period is constant.

5. The method of claim 2, wherein each of the soft start period and the soft end period is profiled so that a ratio of a power amount variation with respect to a time variation has a constant value according to a load characteristic.

6. The method of claim 2, wherein a range of the temperature variation includes a plurality of temperature variation sub-ranges, and the plurality of power capsules are respectively arranged to correspond to the temperature variation sub-ranges.

7. The method of claim 2, wherein the selected power capsule is selected differently according to a warm up mode, a printing mode, and a ready mode.

8. The method of claim 2, wherein the fuser includes a plurality of heaters, and if one of the plurality of heaters enters the full turn on period, the rest of the plurality of heaters are controlled to enter the soft start period after a predetermined time.

9. A fuser temperature control apparatus, comprising:

a temperature sensor for detecting a temperature of a fusing roller heated by a heater;

a switching unit for switching a supply of power from a power supply device to the heater; and a control unit for generating a previously set plurality of power capsules, each including a soft start period in which a power supply is gradually increased to improve a flicker characteristic, a full turn on period in which the power supply is maximum, and a soft end period in which the power supply is gradually decreased to improve the flicker characteristic, wherein each power capsule is profiled to supply a constant amount of power and is set to correspond to a predefined requirement for flicker and harmonic characteristics of an image forming apparatus with respect to the fuser in the soft start period, the full turn on period, and the soft end period, and for controlling the switching unit so as to allow a power corresponding to a power capsule selected from among the plurality of power capsules to be supplied to the heater according to a temperature variation of the fusing roller.

10. The fuser temperature control apparatus of claim 9, wherein the power supply is conducted by performing a phase control or a waveform number control in the soft start period and the soft end period of the selected power capsule.

11. The fuser temperature control apparatus of claim 9, wherein each power capsule in the plurality of power capsules is profiled so that a temporal proportion between the soft start period, the full turn on period, and the soft end period is constant.

12. The fuser temperature control apparatus of claim 9, wherein each of the soft start period and the soft end period of each power capsule in the plurality of power capsules is profiled so that a ratio of a power amount variation with respect to a time variation has a constant value.

13. The fuser temperature control apparatus of claim 9, wherein the control unit defines a range of the temperature variation to have a plurality of temperature variation sub-ranges, and generates the plurality of power capsules respectively corresponding to the temperature variation sub-ranges; and when the temperature of the fusing roller is detected, the control unit controls the switching unit so as to allow the power corresponding to the selected power capsule to be supplied to the heater according to the temperature variation of the fusing roller.

14. The fuser temperature control apparatus of claim 9, wherein the selected power capsule is selected differently according to a warm up mode, a printing mode, and a ready mode.

15. An image forming apparatus comprising:

a power supply device;

a fusing roller containing at least one heater, and heated by the at least one heater;

a temperature sensor detecting a temperature of the fusing roller;

a switching unit switching a supply of power from a power supply device to the heater; and a control unit for generating a previously set plurality of power capsules, each including a soft start period in which a power supply is gradually increased to improve a flicker characteristic, a full turn on period in which the power supply is maximum, and a soft end period in which the power supply is gradually decreased to improve the flicker characteristic, wherein each power capsule is profiled to supply a constant amount of power and is set to correspond to a different, predefined requirement for flicker and harmonic characteristics of an image forming apparatus with respect to the fuser in the soft start period, the full turn on period, and the soft end period, and for controlling the switching unit so as to allow power corresponding to a power capsule selected from among the plurality of power capsules to be supplied to the heater according to a temperature variation of the fusing roller.

16. The image forming apparatus of claim 15, wherein each power capsule in the plurality of power capsules is profiled so that a temporal proportion between the soft start period, the full turn on period, and the soft end period is constant.

17. The image forming apparatus of claim 15, wherein the power supply is conducted by performing a phase control or a waveform number control in the soft start period and the soft end period of the power capsule.

18. The image forming apparatus of claim 15, wherein each of the soft start period and the soft end period is profiled so that a ratio of a power amount variation with respect to a time variation has a constant value.

19. The image forming apparatus of claim 15, wherein the amount of the power supply is determined according to the temperature variation with respect to a reference temperature of the at least one heater of the fuser, and the control unit defines a range of the temperature variation to have a plurality of temperature variation sub-ranges, and generates the plurality of power capsules respectively corresponding to the temperature variation sub-ranges; and when the temperature of the fusing roller is detected, the control unit controls the switching unit so as to allow the power corresponding to the selected power capsule to be supplied to the heater according to the temperature variation of the fusing roller.

20. The image forming apparatus of claim 15, wherein the selected power capsule is differently selected according to a warm up mode, a printing mode, and a ready mode.

21. The image forming apparatus of claim 15, wherein the fuser includes a plurality of heaters, and if one of the plurality of heaters enters the full turn on period, the rest of the plurality of heaters are controlled to enter the soft start period after a predetermined time.

22. A method of controlling a temperature of a heating unit, comprising:

detecting the temperature of the heating unit; and selecting one of a predefined plurality of power capsules to adjust the temperature of the heating unit when the detected temperature is less than a target temperature, wherein each of the plurality of power capsules are differently set to correspond to a characteristic of an image forming apparatus, and wherein each power capsule includes a ramp-up portion during which power is increased, a ramp-down portion in which power is decreased, and a sustained power portion between the ramp-up portion and the ramp-down portion during which power is sustained.

23. The method of claim 22, wherein the selected power capsule has power characteristics that correspond to the difference between the detected temperature and the target temperature.

24. The method of claim 22, wherein the selected power capsule is generated using a phase control profile.

25. The method of claim 22, wherein the selected power capsule is generated using a "number of waveform" profile.

26. The method of claim 22, wherein the temperature of the heating unit is repeatedly detected, and the plurality of power capsules comprise different power characteristics corresponding to a plurality of different temperatures.

27. The method of claim 22, wherein the heating unit has a warm-up mode, a full-power mode, and a ready mode, and power capsules having different power characteristics are selected in each of the warm-up mode, the full power mode, and the ready mode, respectively.

28. The method of claim 22, wherein the heating unit includes a plurality of heating units, the method further comprises:

delaying selecting a second power capsule to apply to a second of the plurality of heating units when a ramp-up portion of a first selected power capsule is supplied to a first heating unit of the plurality of heating units.

29. A fusing unit, comprising:

a fusing roller including a heating unit to receive a power capsule selected from a predetermined plurality of power capsules to heat the fusing roller, each power capsule including a power ramp-up portion, a power ramp-down portion, and a sustained power portion between the ramp-up portion and the ramp-down portion, wherein the selected power capsule is selected to correspond to a characteristic of an image forming apparatus.

30. The fusing unit of claim 29, further comprising:

a sensor to detect a temperature of the fusing roller, wherein the selected power capsule is supplied to the heating unit when a detected temperature of the fusing unit is less than a target temperature.

31. A fuser temperature control apparatus, comprising:

a sensor to detect a temperature of a fusing unit;

a switching unit to switch on and off a power capsule selected from a predetermined plurality of power capsules and supplied to the fusing unit; and a control unit to control the switching unit to supply the power capsule to a heating unit of the fusing unit when the detected temperature is less than a target temperature, wherein the power capsule is set to correspond to a characteristic of an image forming apparatus and includes a power ramp-up portion, a power ramp-down portion, and a sustained power portion between the ramp-up portion and the ramp-down portion.

32. The fuser temperature control apparatus of claim 31, wherein the control unit selects the power capsule based on a difference between the detected temperature and the target temperature.

33. The fuser temperature control apparatus of claim 32, wherein the control unit selects a power capsule having a sustained power portion that has a duration that corresponds to the difference between the detected temperature and the target temperature, such that a larger difference corresponds to a longer duration than that of a smaller difference.

34. The fuser temperature control apparatus according to claim 31, wherein the control unit generates the plurality of power capsules using a phase control profile.

35. The fuser temperature control apparatus according to claim 31, wherein the control unit generates the plurality of power capsules using a "number of waveforms" duty profile.

36. The fuser temperature control apparatus of claim 31, wherein the control unit generates the plurality of power capsules respectively having different power characteristics to correspond to a warm-up mode, a full-power mode, and a ready mode of the heating unit.

37. The fuser temperature control apparatus of claim 31, wherein the heating unit includes a plurality of heating units, and the control unit delays selecting a second power capsule to a second of the plurality of heating units when a ramp-up portion of a first power capsule is supplied to a first heating unit of the plurality of heating units.

38. An image forming apparatus, comprising:

a fusing unit including a heater to heat the fusing unit;

a power supply device to supply power to the fusing unit; and a fuser temperature control apparatus to control the supply of power from the power supply device to the fusing unit, the fuser temperature control apparatus comprising:

a sensor to detect a temperature of the fusing unit; and a controller to control the power from the power supply device to select a power capsule from among a predetermined plurality of power capsules to supply to the fusing unit to heat the fusing unit, each power capsule having a pattern of a power signal that is in the shape of a capsule, wherein a power level gradually increases, evens out at a sustained center portion and gradually decreases at a trailing end, wherein the power capsule is selected to correspond to a characteristic of an image forming apparatus.

* * * * *

UNITED STATES PATENT AND TRADEMARK OFFICE

CERTIFICATE OF CORRECTION

PATENT NO. : 8,781,352 B2
APPLICATION NO. : 12/969768
DATED : July 15, 2014
INVENTOR(S) : Jin-ha Kim It is certified that error appears in the above-identified patent and that said Letters Patent is hereby corrected as shown below:

Title Page, Insert

--(30) Foreign Application Priority Data:

December 16, 2009 (KR).....10-2009-0125695--.

Signed and Sealed this
Thirtieth Day of September, 2014

Michelle K. Lee

Michelle K. Lee
*Deputy Director of the United States Patent and Trademark Office*